US006739070B1

(12) United States Patent
Jacobs et al.

(10) Patent No.: US 6,739,070 B1
(45) Date of Patent: May 25, 2004

(54) WHEELED CARPET DRYER WITH HANDLE

(75) Inventors: Mark Jacobs, Glendale, CA (US); Jess Peña, Yorba Linda, CA (US)

(73) Assignee: EDIC, Los Angeles, CA (US)

( * ) Notice: Subject to any disclaimer, the term of this patent is extended or adjusted under 35 U.S.C. 154(b) by 0 days.

(21) Appl. No.: 10/269,823

(22) Filed: Oct. 11, 2002

(51) Int. Cl.[7] ..... F26B 19/00

(52) U.S. Cl. ..... 34/90; 34/91; 34/554; 34/619

(58) Field of Search ..... 34/90, 91, 151, 34/618, 611, 619, 614, 554; 417/423.1; 415/126, 213.1

(56) References Cited

U.S. PATENT DOCUMENTS

| | | | | | |
|---|---|---|---|---|---|
| 5,048,202 | A | * | 9/1991 | Shero | 34/618 |
| 5,174,048 | A | * | 12/1992 | Shero | 34/444 |
| 5,257,467 | A | * | 11/1993 | White | 34/618 |
| 5,813,139 | A | * | 9/1998 | Lillicotch | 34/618 |
| 6,202,322 | B1 | * | 3/2001 | Turner, IV | 34/618 |

* cited by examiner

*Primary Examiner*—Henry Benneti
*Assistant Examiner*—Camtu Nguyen
(74) *Attorney, Agent, or Firm*—John E. Wagner; Robert C. Smith; Suzanne J. Heeg

(57) ABSTRACT

A dryer for drying textiles is disclosed. The dryer includes a blower for blowing air under the carpet, which includes a blower housing including a sleeve that forms an air outlet opening and a powered fan within the blower housing for blowing air out of the outlet opening. A tow handle is located on the blower housing above the fan and an indentation is included in the underside surface of the blower housing. The indentation has a shape corresponding to the shape of the tow handle such that the indentation can receive a tow handle from a second dryer to allow stacking of dryers. A maneuvering handle is rotatably connected at a first end to the tow handle. The maneuvering handle extends over the blower housing such that a foot located at the second end of the maneuvering handle rests on the upper surface of the blower housing sleeve. A clamp is included on the blower housing for generating a clamping force on the maneuvering handle such that the edge of a textile can be clamped between the foot and the upper surface of the blower housing sleeve. A wheel is also mounted on the blower housing for moving the dryer.

14 Claims, 5 Drawing Sheets

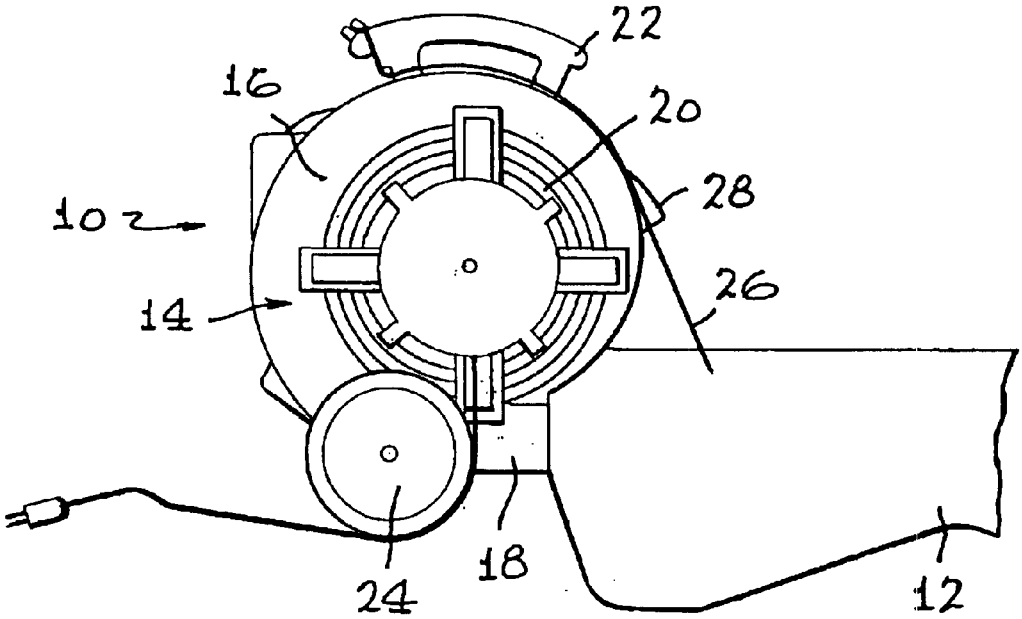
Fig. 1
Fig. 2
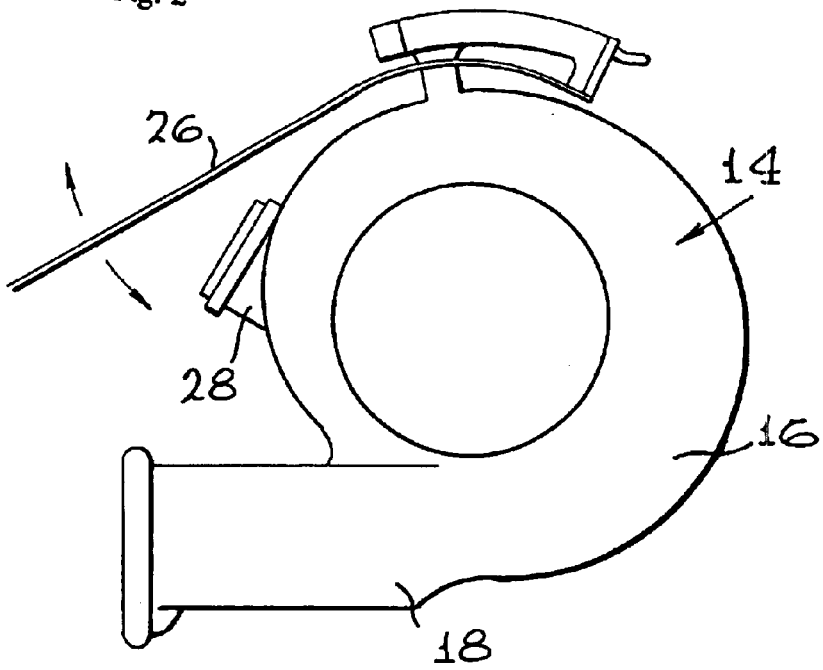

WHEELED CARPET DRYER WITH HANDLE

BACKGROUND OF THE INVENTION

The present invention relates generally to air dryers, and more particularly to a textile or carpet dryer for fixedly securing a carpet to the upper surface of the air outlet portion of the dryer using a maneuvering handle that is rotatably connected to the upper portion of the dryer housing, and which includes a tow handle on the upper portion of the dryer handle, an indentation on the lower surface of the dryer housing for receipt of a tow handle from another dryer, and a wheel.

To avoid costly damage, wet carpeting materials must be dried in a timely and effective manner. Left wet too long, or not completely dried, carpeting materials can be ruined by mildew.

Generally, large commercial air dryer units are utilized to dry carpets. Typically, these devices contain large motor and fan assemblies and are positioned along the outer edges or corners of the carpet such that the air outlet portion of the device is located underneath the carpet to provide a continuous stream of drying air between the carpet and the surface of the underlying floor, drying the carpet from the underside first.

One difficulty that decreases the effectiveness of this method is the tendency of the carpet to be blown off or away from the air dryer, precluding a strong airflow from being maintained between the carpeting and the floor below. This problem can occur if a high-powered dryer produces sufficient force to blow the carpet off or away from the blower, allowing air to spill out around the dryer instead of being forced under the carpet. Solutions to this problem have been attempted and clamps have been mounted on the dryer housing to hold the carpet against the housing.

Another difficulty encountered with many air-drying units is that they are bulky and not easily maneuvered between storage locations and the location of the wet carpet. To enhance maneuverability, maneuvering handles and wheels have been mounted on the dryer housing. The wheels are generally mounted near the back of the dryer housing. The maneuvering handles extend upward such that the handle may be grasped and the dryer rotated on its wheels to lift the front of the dryer. The dryer may be pushed or pulled using the maneuvering handle. While prior art handles have enhanced maneuverability of dryers, the upward and outward orientation of prior art maneuvering handles precludes the stacking of two or more dryers.

The present invention alleviates the problems of prior art carpet dryers by providing a dryer with a maneuvering handle that moves between a first position where it is used to move the dryer between locations, and a second position where it is clamped against the air outlet opening to retain the edge of the carpet in position. The present invention also includes a tow handle and correlated indentation for stacking of dryers.

BRIEF SUMMARY OF THE INVENTION

The present invention is a dryer for drying textiles that comprises a blower for blowing air under the carpet, a maneuvering handle, and a tow handle. The blower includes a blower housing with a sleeve that forms an air outlet opening. A powered fan within the blower housing is also included for blowing air out of the outlet opening. The tow handle is located on the blower housing above the fan. To facilitate stacking of dryers, an indentation having a shape corresponding to the shape of the tow handle is included in the underside surface of the blower housing for receipt of a tow handle from a second dryer.

A maneuvering handle is rotatably connected at a first end to the tow handle. The maneuvering handle extends over the blower housing such that a foot located at the second end of the maneuvering handle rests on the upper surface of the blower housing sleeve. A clamp is included on the blower housing for generating a clamping force on the maneuvering handle such that the edge of a textile can be clamped between the foot and the upper surface of the blower housing sleeve. Lastly, a wheel is mounted on the blower housing. When the maneuvering handle is rotated upward and away from the blower housing, the dryer can be tilted onto the wheel to facilitate movement between locations.

In a detailed embodiment of the invention, the maneuvering handle includes two parallel arms and a bracket at the first end. The bracket is rotatably connected at a first end to the tow handle. In a detailed embodiment of the clamp, the clamp comprises a block molded on the blower housing. Grooves are molded into each side of the block for receipt of the maneuvering handle arms.

In accordance with another detail of the invention, the dryer includes a supporting bar rotatably connected to the lower surface of the blower housing sleeve. The supporting bar rotates between a first position where the supporting bar is rotated under the blower housing sleeve to vertically adjust the air outlet opening, and a second position where the supporting bar rests against the lower surface of the blower housing sleeve.

An object of the present invention is to provide a portable carpet dryer having a mechanism for securing carpeting to the top surface of the air outlet portion of the device, while also providing a handle for maneuvering the dryer.

Another object of the present invention is to provide a portable carpet dryer having a tow handle on the housing to aid in lifting and transporting the dryer, and a corresponding indentation on the underside of the dryer to facilitate stacking of dryers.

Further objects and advantages of the invention will become apparent to those skilled in the art upon reading and consideration of the following description of a preferred embodiment and the accompanying drawings.

BRIEF DESCRIPTION OF THE DRAWINGS

The accompanying drawings, which are incorporated herein and form part of the specification, illustrate embodiments of the present invention and, together with the description, further serve to explain the principles of embodiments of the invention.

FIG. 1 is a perspective view of the present invention as positioned during a carpet drying process;

FIG. 2 is a side elevational view of the present invention illustrating the movement of the maneuvering handle;

DETAILED DESCRIPTION

Figure 3:
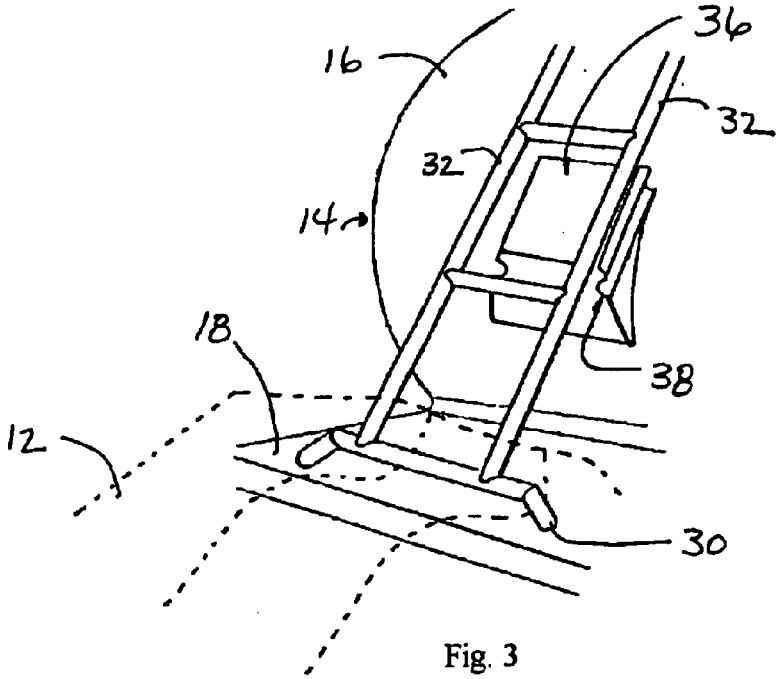
FIG. 3 is a partial perspective view of the maneuvering handle and clamp of the present invention.

Referring to FIG. 1, a dryer 10 for drying textiles is shown. In particular, FIG. 1 illustrates the positioning of the dryer with respect to a carpet 12 during the drying process. The dryer is generally comprised of a blower housing 14, which includes a cylindrical portion 16 and a sleeve 18 that forms an air outlet opening. For ease of description, the portion of the dryer that includes the open end of the sleeve is referenced as the "front" of the dryer, the opposite portion is referenced as the "back" of the dryer, and the portions of the dryer that are perpendicular to the front and the back of the dryer are referenced as the "sides" of the dryer. The housing is preferably rotationally molded or otherwise constructed from a suitable plastic or other lightweight material. A powered fan 20 is mounted within the blower housing for blowing air out of the air outlet opening. In the preferred embodiment, a tow handle 22 is molded to the housing above the fan, and a wheel 24 is mounted on either side of the housing below the fan.

Figure 4:
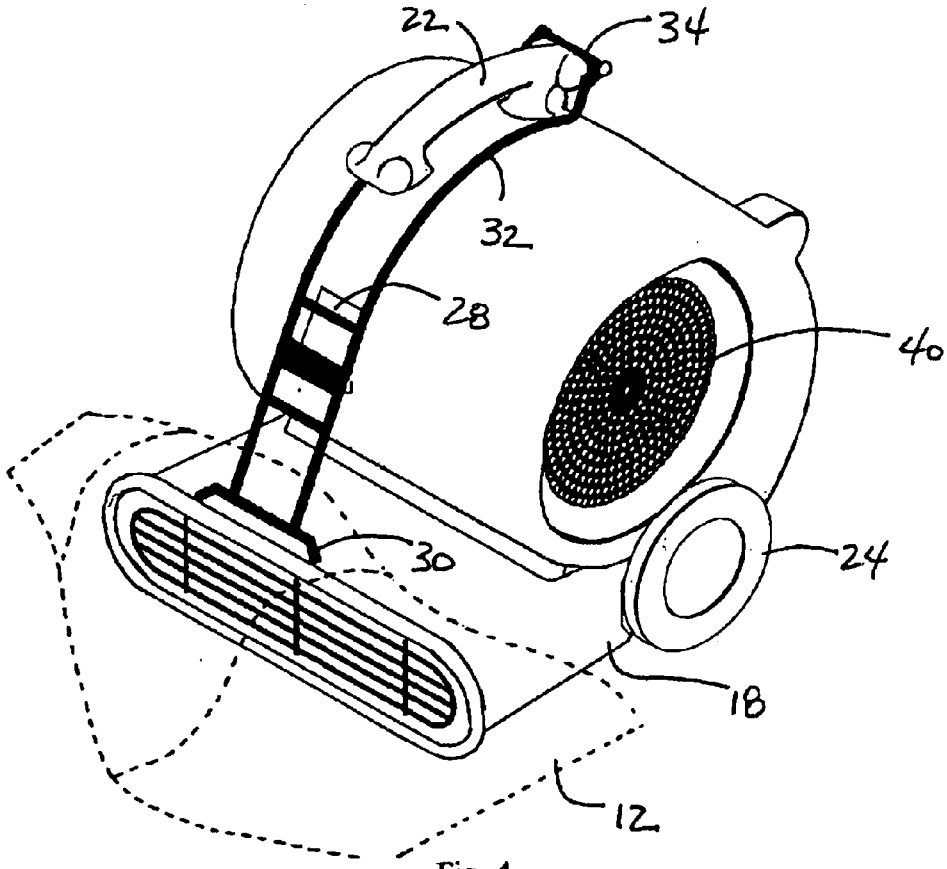
FIG. 4 is a perspective view of the present invention illustrating the maneuvering handle in the downward position.

A maneuvering handle 26 and clamp 28 are illustrated in FIGS. 1 and 2. The outer end of the maneuvering handle clamps the carpet 12 on top of the sleeve 18 of the dryer 10. As illustrated in FIGS. 3 and 4, in the preferred embodiment, the maneuvering handle includes two parallel arms 32 and a bracket 34 at one end. The bracket rotatably connects the maneuvering handle to the end of the tow handle 22 that is furthest from the air outlet opening. The maneuvering handle extends over the blower housing such that a foot 30 located at the remote end of the maneuvering handle rests against the upper surface of the sleeve 18 near the front of the dryer in a position to lock the carpet (shown in dashed lines in a clamped drying position).

As shown in FIG. 3, in the preferred embodiment, the clamp comprises a block 36 that is molded on the front of the cylindrical portion 16 of the blower housing 14. The block has a groove 38 on either side for receipt of the maneuvering handle arms 32. When the arms of the maneuvering handle 26 are pushed down into the clamp grooves, the block generates a clamping force on the maneuvering handle such that the edge of the carpet 12 is securely fastened to the top of the sleeve 18, as shown in FIG. 1. When the fan 20 is activated, air is pulled in an air intake opening 40 (FIG. 4) and centrifugally blown through the sleeve 18 at a high speed beneath the carpet (again shown in dashed lines). The airflow exerts a force on the carpet in a direction upward and away from the dryer 10. The maneuvering handle and clamp secure the carpet to the dryer and ensure that the airflow from the blower travels below the carpet to dry the carpet from below.

Figure 5:
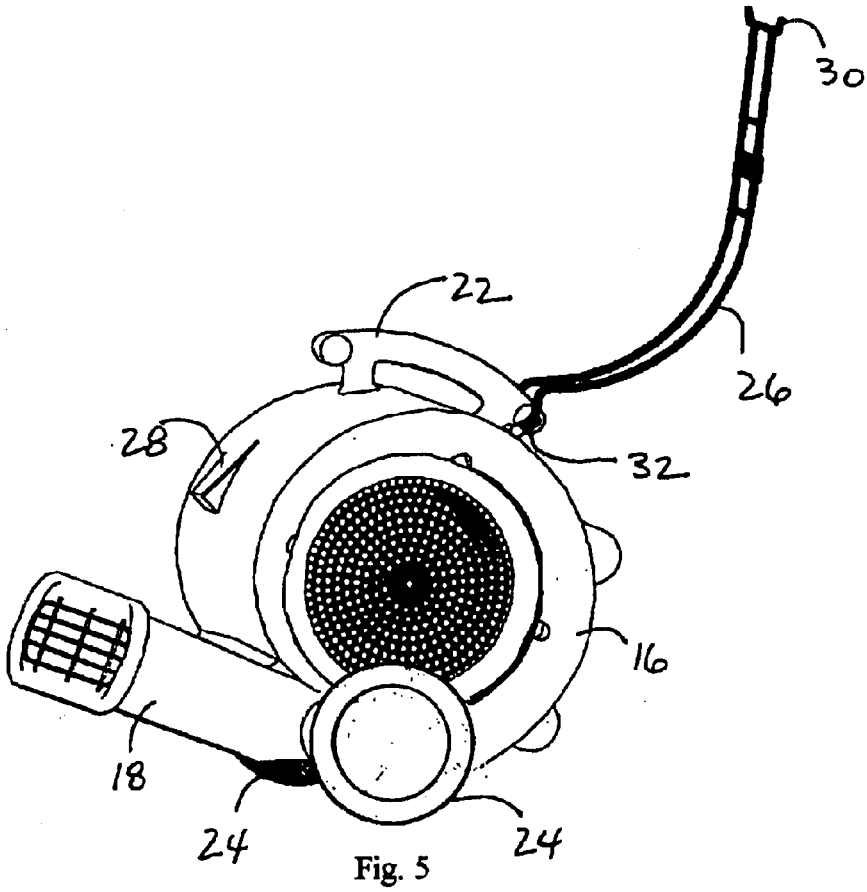
FIG. 5 is a perspective view of the present invention illustrating the maneuvering handle in the upward position.

As illustrated in FIG. 5, when the maneuvering handle 26 is released from the clamp 28, the maneuvering handle may be rotated upward and away from the sleeve 18. In the preferred embodiment, the ends of the arms 32 that are located adjacent to the tow handle 22 rest against the top of the cylindrical portion 16 when the maneuvering handle is fully rotated upward. At this point, further backward rotation of the maneuvering handle foot 30 causes the dryer 10 to rotate on the wheels 24 and the front of the sleeve to lift. The dryer may then be easily moved to a new location by exerting force on the maneuvering handle.

Figure 8:
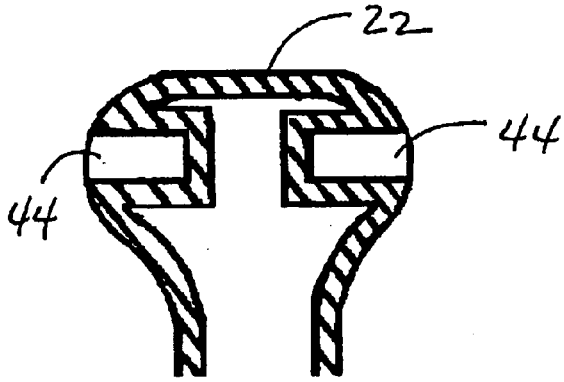
FIG. 8 is a sectional view of the end of the tow handle.
Figure 6:
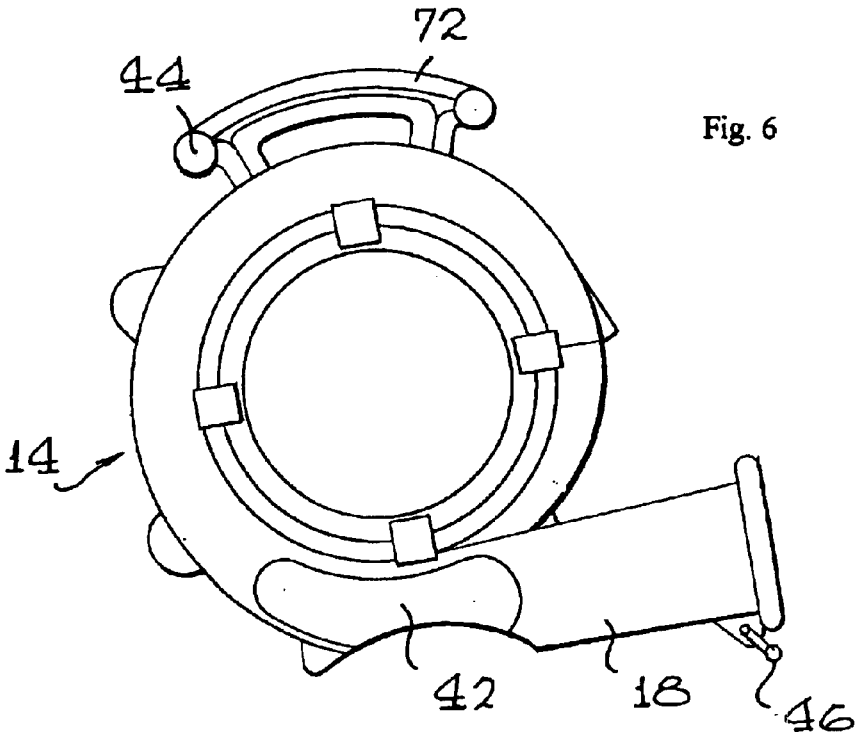
FIG. 6 is a side elevational view of the present invention illustrating the tow handle, the tow handle indentation and the supporting bar.
Figure 7:
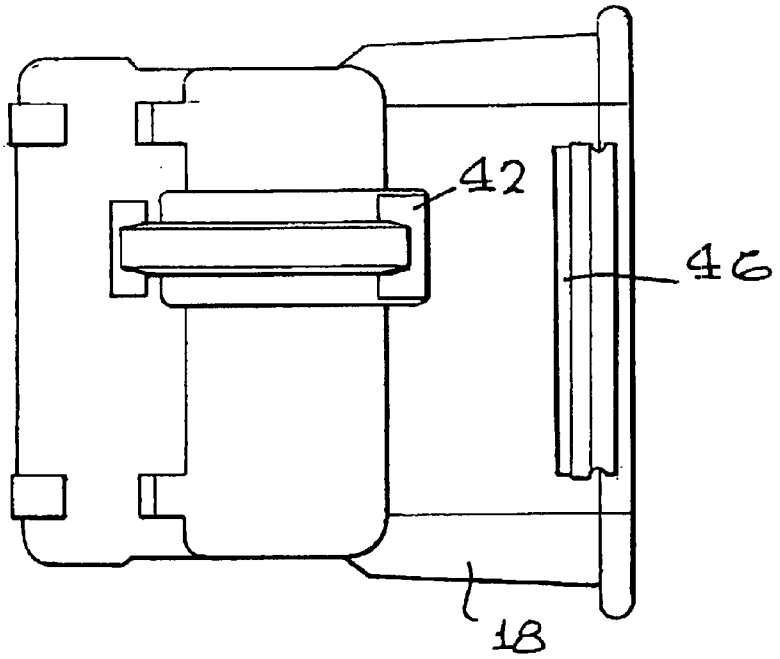
FIG. 7 is a bottom plan view of the underside surface of the present invention illustrating the tow handle indentation and the supporting bar.

FIGS. 6, 7, and 8 illustrate the preferred embodiments of the tow handle 22 and an indentation 42. As shown in FIG. 8, the tow handle includes two pivot receivers 44 at the back end of the tow handle for rotatably connecting the back end of the maneuvering handle (not shown) to the blower housing 14. To facilitate stacking of dryers 10, the underside surface of the blower housing includes the indentation 42 (shown in FIGS. 6 and 7) located generally below the tow handle. The indentation has a shape that corresponds to the shape of the top of the tow handle such that the indentation can receive a tow handle from a second dryer.

Figure 9:
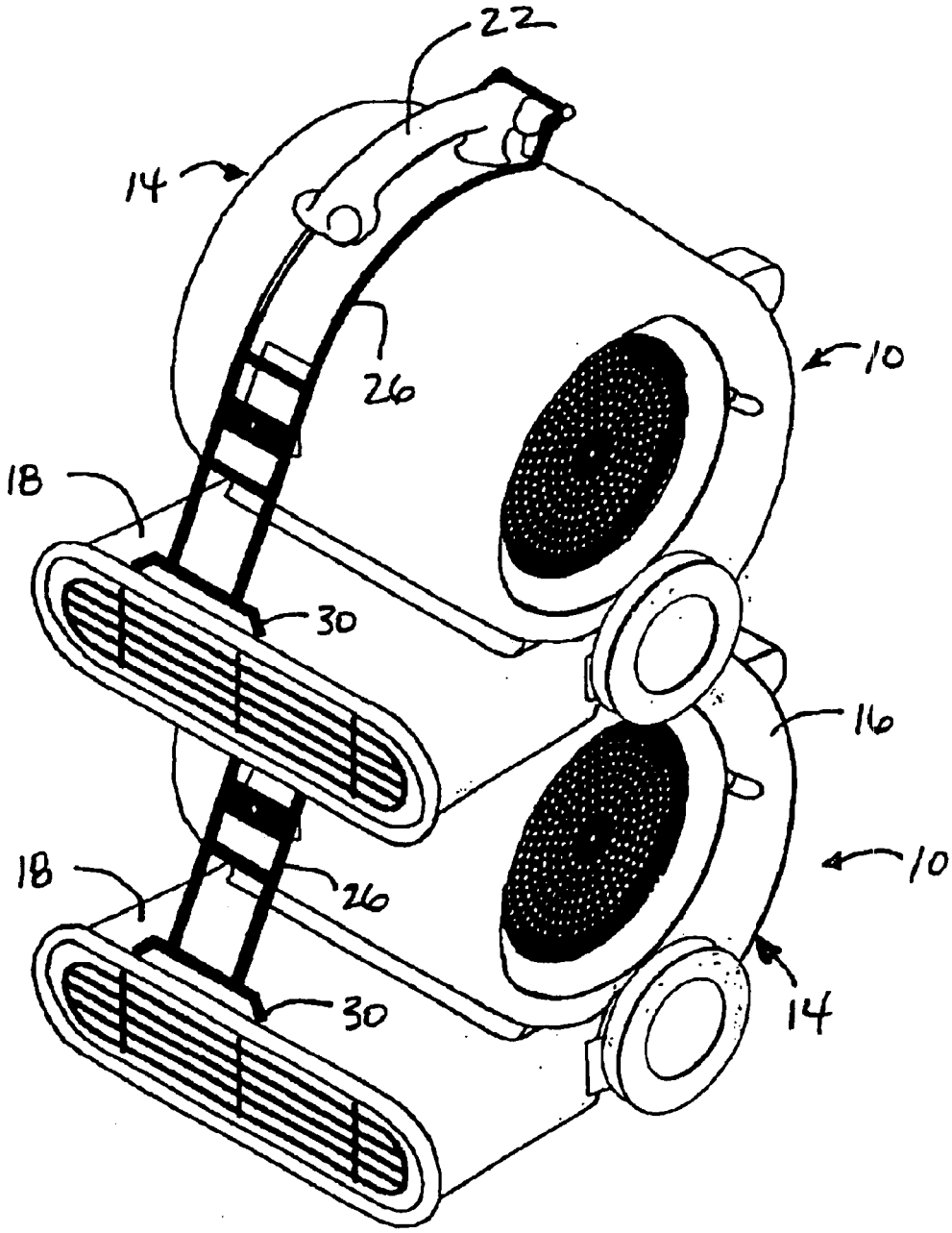
FIG. 9 is a perspective view of two stacked dryers in accordance with the present invention.

FIG. 9 illustrates the stacking of two dryers 10. First, the maneuvering handle 26 is rotated to a downward position over the cylindrical portion 16 of the blower housing 14 such that the foot 30 of each dryer rests against the top surface of the sleeve 18. Then, the tow handle 22 of the lower dryer is inserted in the indentation 42 (not shown in FIG. 9) of the upper dryer. Because the shape of the indentation generally corresponds to the shape of the tow handle, upon insertion of a tow handle in an indentation, the undersurface of the upper dryer rests upon the upper surface of the cylindrical portion of the lower dryer to securely stack the two dryers. The configuration of the maneuvering handle over the blower housing produces a handle that can be placed in the upward position to maneuver the dryer, and placed in the downward position to clamp carpet and to stack two or more dryers.

FIGS. 6 and 7 also illustrate the use of a supporting bar 46 that is rotatably connected to the lower surface of the sleeve 18. In a first position, the supporting bar rotates under the blower housing sleeve to vertically adjust the air outlet opening as illustrated in FIG. 6. In a second position, the supporting bar rests against the lower surface of the sleeve as illustrated in FIG. 7.

While various embodiments of the present invention have been described above, it should be understood that they have been presented by way of example only, and not limitation. It will be understood by those skilled in the art that various changes in form and details may be made therein without departing from the spirit and scope of the invention as defined in the appended claims. For example, while the preferred embodiment of the maneuvering handle includes two parallel arms, any suitable structure may be used. Similarly, while a supporting bar is described to vertically adjust the front of the dryer 10, adjustable threaded feet may be used instead of a supporting bar. Additional modifications and improvements of the present invention may also be apparent to those skilled in and the art. Thus, the breadth and scope of the present invention should not be limited by any of the above-described exemplary embodiments, but should be defined only in accordance with the following claims and their equivalents.

We claim:

1. A dryer for drying carpets comprising:

a. a blower for blowing air under the carpet, the blower including:

i. a blower housing including a sleeve that forms an air outlet opening;

ii. a powered fan within the blower housing for blowing air out of the outlet opening; and b. a maneuvering handle having a first end and a second end, the maneuvering handle being rotatably connected at the first end to the blower housing and extending over the blower housing such that the second end of the maneuvering handle rests on the upper surface of the blower housing sleeve; and c. a clamp on the blower housing for generating a clamping force on the maneuvering handle such that the edge of a carpet can be clamped between the maneuvering handle and the upper surface of the blower housing sleeve.

2. The dryer of claim 1, wherein:

a. the maneuvering handle further includes two parallel arms rotatably connected at a first end to the blower housing above the fan; and b. the clamp comprises a block molded on the blower housing and having a groove on each side for receipt of the maneuvering handle arms.

3. The dryer of claim 1, further comprising a tow handle on the blower housing.

4. The dryer of claim 3 wherein:

a. the tow handle is molded on the blower housing; and b. the underside surface of the blower housing includes an indentation having a shape corresponding to the shape of the tow handle such that the indentation can receive a tow handle from a second dryer to allow stacking of dryers.

5. The dryer of claim 3 wherein the tow handle has two pivot receivers at one end for rotatably connecting the first end of the maneuvering handle to the blower housing.

6. The dryer of claim 1 wherein the maneuvering handle is configured to fold over the blower housing for stacking of dryers and clamping of carpets.

7. The dryer of claim 1, further comprising at least one wheel mounted on the blower housing.

8. The dryer of claim 1, further comprising a supporting bar rotatably connected to the lower surface of the blower housing sleeve, the supporting bar rotating between a first position where the supporting bar rotates under the blower housing sleeve to vertically adjust the air outlet opening, and a second position where the supporting bar rests against the lower surface of the blower housing sleeve.

9. A dryer for drying carpet comprising:

a. a blower for blowing air under the carpet, the blower including:

i. a blower housing including a sleeve that forms an air outlet opening;

ii. a powered fan within the blower housing for blowing air out of the outlet opening;

b. a tow handle on the blower housing;

c. an indentation in the underside surface of the blower housing, the indentation having a shape corresponding to the shape of the tow handle such that the indentation can receive a tow handle from a second dryer to allow stacking of dryers; and d. at least one wheel mounted on the blower housing.

10. The dryer of claim 9, further comprising:

a. a maneuvering handle having a first end and a second end, the maneuvering handle being rotatably connected at the first end to the blower housing and extending over the blower housing such that the second end of the maneuvering handle rests on the upper surface of the blower housing sleeve; and b. a clamp on the blower housing for generating a clamping force on the maneuvering handle such that the edge of a carpet can be clamped between the maneuvering handle and the upper surface of the blower housing sleeve.

11. The dryer of claim 10, wherein:

a. the maneuvering handle further includes two parallel arms rotatably connected at a first end to the blower housing above the fan; and b. the clamp comprises a block molded on the blower housing and having a groove on each side for receipt of the maneuvering handle arms.

12. The dryer of claim 10 wherein the maneuvering handle is configured to fold over the blower housing for stacking of dryers and clamping of carpets.

13. The dryer of claim 9, further comprising a supporting bar rotatably connected to the lower surface of the blower housing sleeve, the supporting bar rotating between a first position where the supporting bar rotates under the blower housing sleeve to vertically adjust the air outlet opening, and a second position where the supporting bar rests against the lower surface of the blower housing sleeve.

14. A dryer for drying carpet comprising:

a. a blower for blowing air under the carpet, the blower including:

i. a blower housing including a sleeve that forms an air outlet opening;

ii. a powered fan within the blower housing for blowing air out of the outlet opening;

b. a tow handle on the blower housing;

c. an indentation in the underside surface of the blower housing, the indentation having a shape corresponding to the shape of the tow handle such that the indentation can receive a tow handle from a second dryer to allow stacking of dryers;

d. a maneuvering handle having a first end and a second end, the maneuvering handle being rotatably connected at the first end to the tow handle and extending over the blower housing such that the second end of the maneuvering handle rests on the upper surface of the blower housing sleeve; and e. a clamp on the blower housing for generating a clamping force on the maneuvering handle such that the edge of a carpet can be clamped between the maneuvering handle and the upper surface of the blower housing sleeve.

* * * * *